US009416524B2

(12) United States Patent
Hall et al.

(10) Patent No.: US 9,416,524 B2
(45) Date of Patent: Aug. 16, 2016

(54) PISTON-FLUSH TOILET SYSTEM

(71) Applicants: David R. Hall, Provo, UT (US); Jon Marshall, Springville, UT (US); Joshua Larsen, Spanish Fork, UT (US); Jared Reynolds, Provo, UT (US); Corbin Englund, Provo, UT (US)

(72) Inventors: David R. Hall, Provo, UT (US); Jon Marshall, Springville, UT (US); Joshua Larsen, Spanish Fork, UT (US); Jared Reynolds, Provo, UT (US); Corbin Englund, Provo, UT (US)

( * ) Notice: Subject to any disclaimer, the term of this patent is extended or adjusted under 35 U.S.C. 154(b) by 259 days.

(21) Appl. No.: 14/198,385

(22) Filed: Mar. 5, 2014

(65) Prior Publication Data

US 2015/0252556 A1 Sep. 10, 2015

Related U.S. Application Data

(60) Provisional application No. 61/772,776, filed on Mar. 5, 2013, provisional application No. 61/823,525, filed on May 15, 2013, provisional application No. 61/863,771, filed on Aug. 8, 2013, provisional application No. 61/865,421, filed on Aug. 13, 2013, provisional application No. 61/907,117, filed on Nov. 21, 2013.

(51) Int. Cl.

| | |
|---|---|
| ***E03D 9/10*** | (2006.01) |
| ***E03D 5/012*** | (2006.01) |
| ***E03D 5/08*** | (2006.01) |
| *E03D 5/10* | (2006.01) |

(52) U.S. Cl.

CPC *E03D 5/012* (2013.01); *E03D 5/08* (2013.01); *E03D 5/10* (2013.01)

(58) Field of Classification Search

CPC ..... E03D 5/012; E03D 5/02; E03D 5/024; E03D 5/026; E03D 5/08; E03D 5/01; E03D 9/10; E03D 9/00; E03D 9/0005; E03D 11/10; E03D 11/11

USPC ..... 4/319, 320, 321, 323, 431, 434, 407, 4/255.02, 255.03, 661, 662, 432, 433

See application file for complete search history.

(56) References Cited

U.S. PATENT DOCUMENTS

| | | | | | |
|---|---|---|---|---|---|
| 288,655 | A | * | 11/1883 | Muirhead | E03D 5/012 137/247.21 |
| 2,580,134 | A | * | 12/1951 | Shook | B63B 29/00 4/433 |
| 2,807,025 | A | * | 9/1957 | King | B63B 29/14 222/381 |
| 3,228,036 | A | * | 1/1966 | Gast | B02C 18/0092 222/133 |
| 3,247,525 | A | * | 4/1966 | O'Brien | E03D 5/026 4/438 |
| 3,522,613 | A | * | 8/1970 | Botsford | A47K 11/023 4/111.2 |
| 3,585,649 | A | | 6/1971 | Miya | |
| 3,878,569 | A | * | 4/1975 | Peirish, Jr. | E03D 9/10 241/101.2 |
| 4,145,772 | A | * | 3/1979 | Whitney | E03D 1/286 4/300 |

(Continued)

FOREIGN PATENT DOCUMENTS

| | | | | |
|---|---|---|---|---|
| WO | WO 8706289 | A2 | * 10/1987 | E03D 9/00 |

OTHER PUBLICATIONS

WO 8706289 A2—English Translation; machine generated, Mar. 2016.*

*Primary Examiner* — J. Casimer Jacyna
*Assistant Examiner* — Benjamin R Shaw

(57) ABSTRACT

The present invention comprises a piston-flush toilet system that may use appreciably less water than commonly used toilets today. Such a piston-flush toilet system may comprise a bowl to accept waste and a chamber comprising a waste inlet connected to the bowl and a waste outlet connected to a sewer system or the like. A piston may be disposed within the chamber capable of sealing the waste inlet.

15 Claims, 9 Drawing Sheets

(56) References Cited

U.S. PATENT DOCUMENTS 4,636,474 A 1/1987 Ogura
4,742,941 A * 5/1988 Tastet ..... A21C 5/02 222/309
4,961,431 A 10/1990 Ikenaga
4,962,550 A 10/1990 Ikenaga
5,022,098 A * 6/1991 Brower ..... A47K 13/10 4/233
5,062,304 A 11/1991 Van Buskirk
5,111,539 A 5/1992 Hiruta
5,184,359 A 2/1993 Tsukamura
5,198,192 A 3/1993 Saito
5,410,471 A 4/1995 Alyfuku
5,920,920 A * 7/1999 Chi ..... E03D 5/012 137/391
5,987,658 A * 11/1999 Richards ..... B63B 29/14 4/300
5,991,931 A * 11/1999 Hawkins ..... A47K 11/023 4/111.4
6,101,641 A * 8/2000 Hawkins ..... A47K 11/02 4/449
6,572,564 B2 6/2003 Ito
6,684,418 B2 2/2004 Choi
6,910,231 B2 6/2005 Breiing
8,117,682 B1 * 2/2012 Bowden ..... E03D 9/085 4/223
2001/0049841 A1 * 12/2001 Lee ..... E03D 1/003 4/441
2004/0064881 A1 * 4/2004 Breiing ..... E03F 1/006 4/431
2004/0181865 A1 * 9/2004 Egeresi ..... A47K 13/30 4/420.4
2006/0075545 A1 * 4/2006 Herbst ..... E03D 5/08 4/249
2006/0102261 A1 * 5/2006 Etter ..... F04B 41/02 150/154
2007/0240255 A1 * 10/2007 Grech ..... B60R 15/04 4/319
2007/0245472 A1 * 10/2007 Kao ..... E03D 9/005 4/300
2008/0244819 A1 * 10/2008 Meador ..... E03D 9/00 4/434
2009/0077731 A1 * 3/2009 Hiranuma ..... E03F 1/006 4/319
2010/0186156 A1 * 7/2010 Ophardt ..... E03D 9/00 4/301
2011/0051125 A1 3/2011 Kim

* cited by examiner

PISTON-FLUSH TOILET SYSTEM

CROSS REFERENCE TO RELATED APPLICATIONS

This patent application claims priority to U.S. Provisional Pat. App. Nos. 61/772,776 filed Mar. 5, 2013; 61/823,525 filed May 15, 2013; 61/863,771 filed Aug. 8, 2013; 61/865,421 filed Aug. 13, 2013; and 61/907,117 filed Nov. 21, 2013; which are incorporated herein by reference for all that they contain.

BACKGROUND OF THE INVENTION

The present invention relates generally to low-water toilet systems. More particularly, the present invention relates to using mechanical means to transport waste away from a toilet.

Common toilet systems currently in use consume large amounts of water. There are several reasons for this. First, water acts as a transport medium allowing waste to travel through piping networks. Second, water blocks odors from waste and from sewer systems from reaching users. As populations grow, however, natural resources may become scarcer, increasing the need to conserve water. As such, there has been much effort devoted to creating low-water toilet systems.

As populations age, there is also an increasing need for daily health monitoring systems for early detection of preventable illnesses. Ideally, such health monitoring systems would perform their duties with as little inconvenience to the individual being monitored as possible. A variety of information about a person's health can be derived from their excrement. As such, there have been various attempts to incorporate health monitoring systems into toilet systems which people use every day.

For example, U.S. Pat. No. 4,636,474 to Ogura et al., which is incorporated herein for all that it contains, discloses a toilet apparatus comprising a detecting sensor for detecting constituents in the feces, urine, or both of a user, and an indicator for indicating or informing the user of his health based upon abnormalities in the constituents detected by the sensor. It has been found that the amount of water used in many current toilet systems dilutes samples thus hindering health monitoring. Thus, in health-monitoring toilet applications, the need for low-water solutions is even greater.

One attempt to create a low-water toilet is shown in U.S. Pat. No. 3,585,649 to Miya, which is incorporated herein for all that it contains. Miya discloses a defecating system in which foam is provided. Excrement is sealed by the foam visually, odorproofly, and hygienically without necessity of an appreciable quantity of water. While the use of foam does reduce the water required, it tends to move significantly slower than water without additional propulsion means.

Another example of a low-water toilet system is disclosed in U.S. Pat. No. 6,910,231 to Breiing et al., which is incorporated herein for all that it contains. Breiing et al. discloses means for transporting a material from a toilet pan into a sanitation pipe comprising two valves which are arranged in a pipe and a pressure chamber disposed in-between. Rather than water, the pressure chamber creates suction which transports the waste. Accurate control of the multiple valves and pressure chamber are necessary which may increase complication and cost.

An example of a health-monitoring toilet system that attempts to mitigate water dilution is shown in U.S. Pat. No. 4,962,550 to Ikenaga et al., which is incorporated herein for all that it contains. Ikenaga et al. discloses a toilet with a device for measuring constituents of voided urine. The toilet has a urine reservoir having a surface contiguous to a bowl surface including a urine receiving surface. Urine examined by the measuring device is sampled from the urine reservoir before it enters any water.

While there have been various attempts at producing both low-water toilets and health-monitoring toilets there is still much room for improvement in the art.

BRIEF SUMMARY OF THE INVENTION

The present invention comprises a piston-flush toilet system that may use appreciably less water than commonly used toilets today. Such a piston-flush toilet system may comprise a bowl to accept waste and a chamber comprising a waste inlet connected to the bowl and a waste outlet connected to a sewer system or the like. A piston may be disposed within the chamber capable of sealing the waste inlet. In various embodiments, the chamber may be positioned beneath the bowl such that gravity may transport waste from the bowl to the chamber. In some embodiments, the chamber may be positioned horizontally, or at an angle such that gravity may aid in transporting waste entering the chamber from the bowl at the waste inlet to the waste outlet. The bowl and chamber may be formed of a solid member that may be formed of plastic or ceramic.

In some embodiments, a macerating unit may be disposed within the chamber between the piston and the waste outlet. In other various embodiments, a one-way valve, an elastic stopper, or a rigid stopper held by a spring, may be disposed within the chamber between the piston and the waste outlet to allow waste to exit the chamber through the waste outlet without returning.

Some embodiments may comprise a foam generating system for supplying foam to the bowl, chamber or both. This may occur as the piston retracts to unseal the waste inlet. Such foam may comprise a lubricant to aid gravity in transporting waste from the bowl to the chamber.

Embodiments may also include a motorized or user-powered air compressor for providing compressed air. The compressed air may pressurize the piston, mix with surfactant and water to produce foam or both.

Some embodiments may provide health monitoring functions through a microchip disposed within the chamber for measuring characteristics of the waste. In such embodiments, the piston may compress waste against the microchip during its cycle. The piston may also comprise a light source that may pass light through the waste to the microchip or a reflective surface that may reflect light through the waste to the microchip.

DETAILED DESCRIPTION OF THE INVENTION

Figure 1:
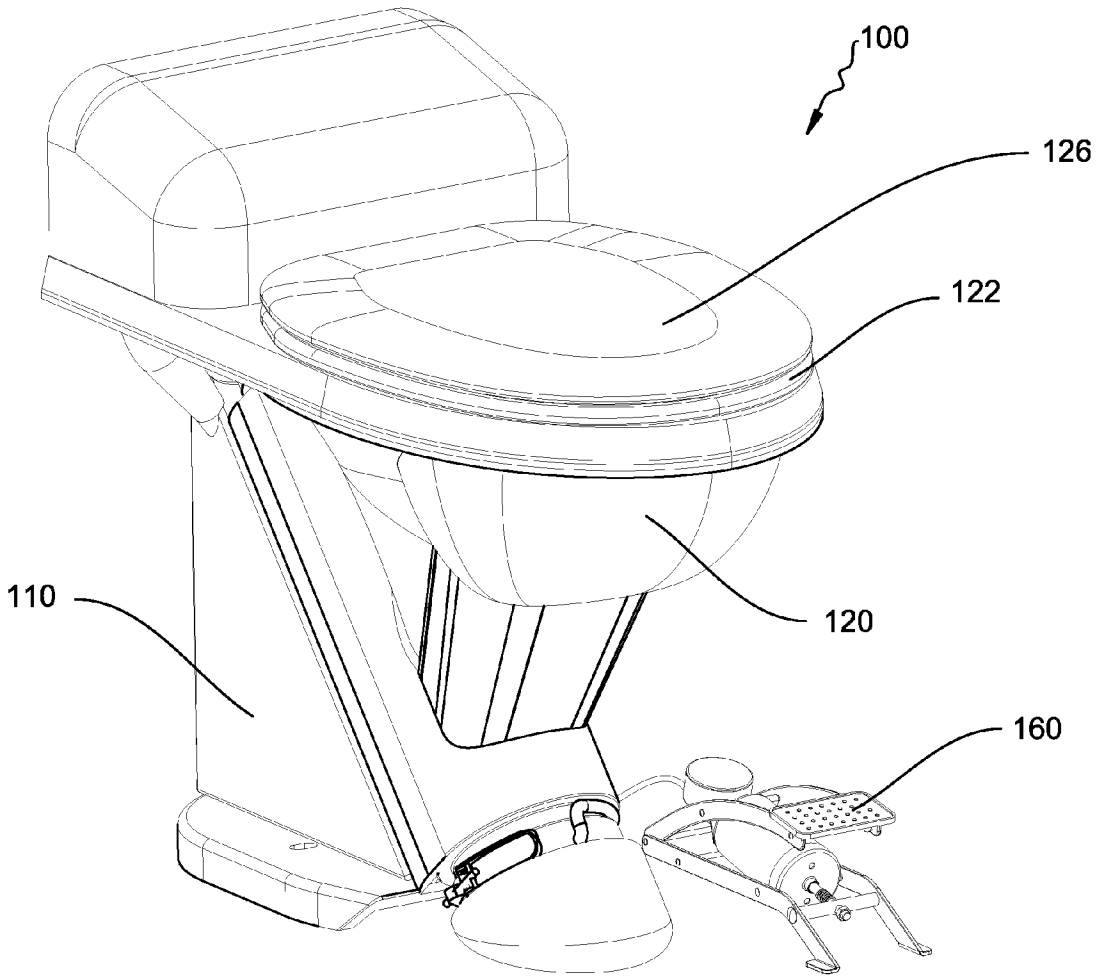
FIG. 1 is a perspective view of an embodiment of a piston-flush toilet system.

Referring now to the figures, FIG. 1 shows an embodiment of a piston-flush toilet system 100 of the present invention. The piston-flush toilet system 100 may comprise a base portion 110 supporting a bowl 120 for accepting human waste. In the embodiment shown, the bowl 120 comprises a seat 122 surrounding an opening of the bowl 120 upon which a user may sit and a cover 126 spanning the opening of the bowl 120 concealing its contents. Further shown is a user-powered pump 160 for compressing air that may be used to expel waste from the piston-flush toilet system 100 with appreciably less water than is commonly used in toilets today.

Figure 2:
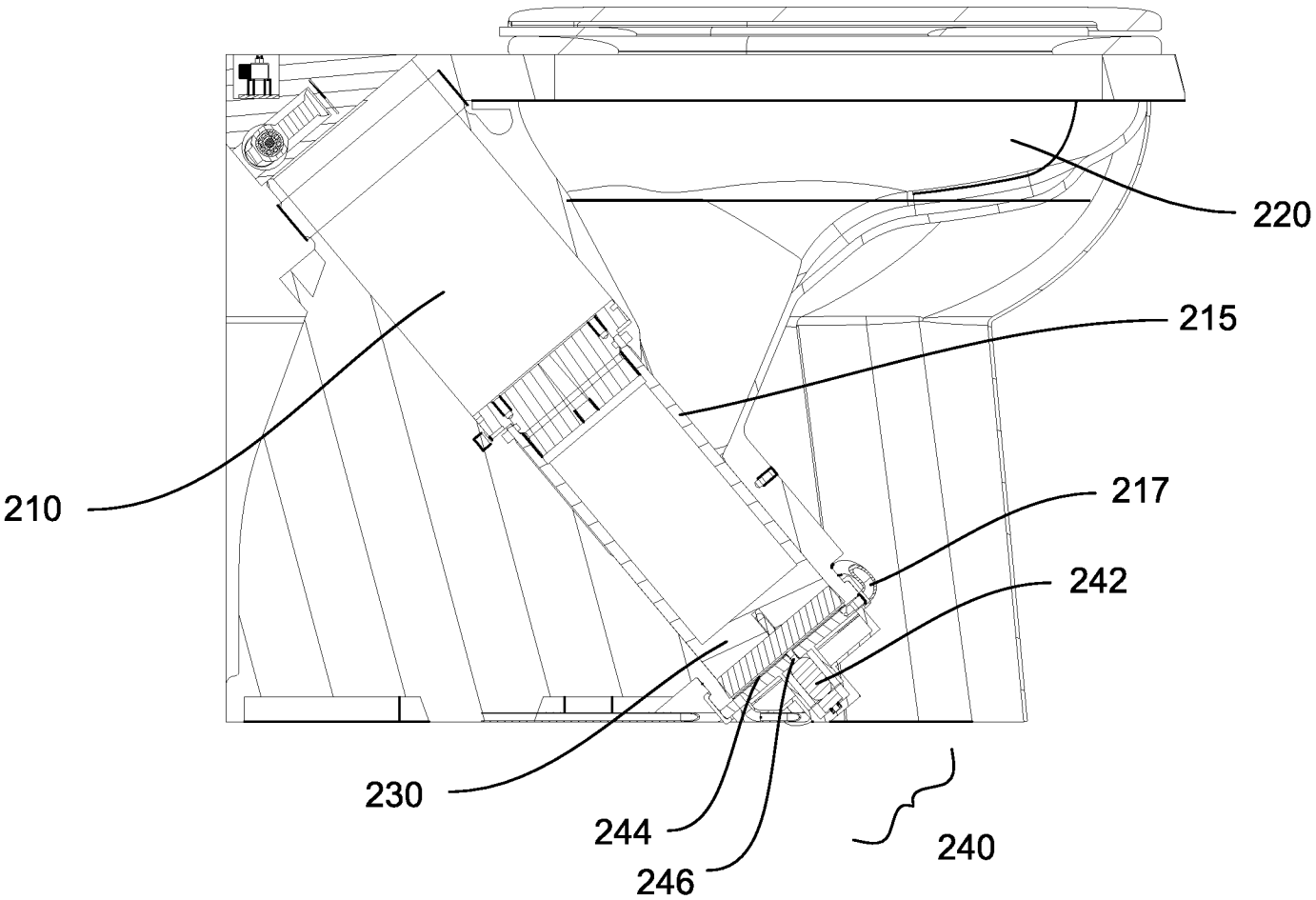
FIG. 2 is a cross-sectional view of an embodiment of a piston-flush toilet system with a piston in a compressed position.

FIG. 2 shows the inner workings of an embodiment of a piston-flush toilet system 200 comprising a chamber 210 disposed adjacent a bowl 220. The chamber 210 may comprise a waste inlet 215 connecting the chamber 210 to the bowl 220 where waste from the bowl 220 may flow into the chamber 210 and a waste outlet 217 where waste may exit the chamber 210 to a sewer system or fertilizer production operation. A piston 230 may be disposed within the chamber 210. The piston 230 may be capable of cycling between compressed and retracted positions. In FIG. 2, the piston 230 is shown in a compressed position wherein which the piston 230 may seal the waste inlet 215.

A macerating unit 240 may also be disposed within the chamber 210 between the piston 230 and the waste outlet 217. The macerating unit 240 may comprise a motor 242 that may rotate a blade 244 via a shaft 246 thus turning waste compressed by the piston 230 into slurry. It is believed that turning waste into substantially uniform slurry, by use of a macerator or other means, may aid in the compression and transportation of such waste out through the waste outlet 217, the formation of such waste into fertilizer, and/or the examination of such waste for health monitoring.

As can be seen in FIG. 2, the bowl 220 and the chamber 210 may be formed from a solid member. Such simplified construction may allow for tight seals between the bowl 220 and chamber 210 and for ease of manufacture, assembly and cleaning. Further, the solid member may be formed of plastic. It is believed that the appreciably less water used in the piston-flush toilet system of the present invention, as compared with common toilet systems currently in use today, may allow for plastic construction, rather than the typically more expensive ceramic construction.

As also viewable in FIG. 2, the chamber 210 may be positioned beneath the bowl 220 such that gravity may transport waste from the bowl to the chamber. The chamber 210 may further be positioned at an angle such that gravity may transport waste entering the chamber 210 at the waste inlet 215 to the waste outlet 217. In other embodiments, a chamber may be positioned horizontally to conserve space.

Figure 3:
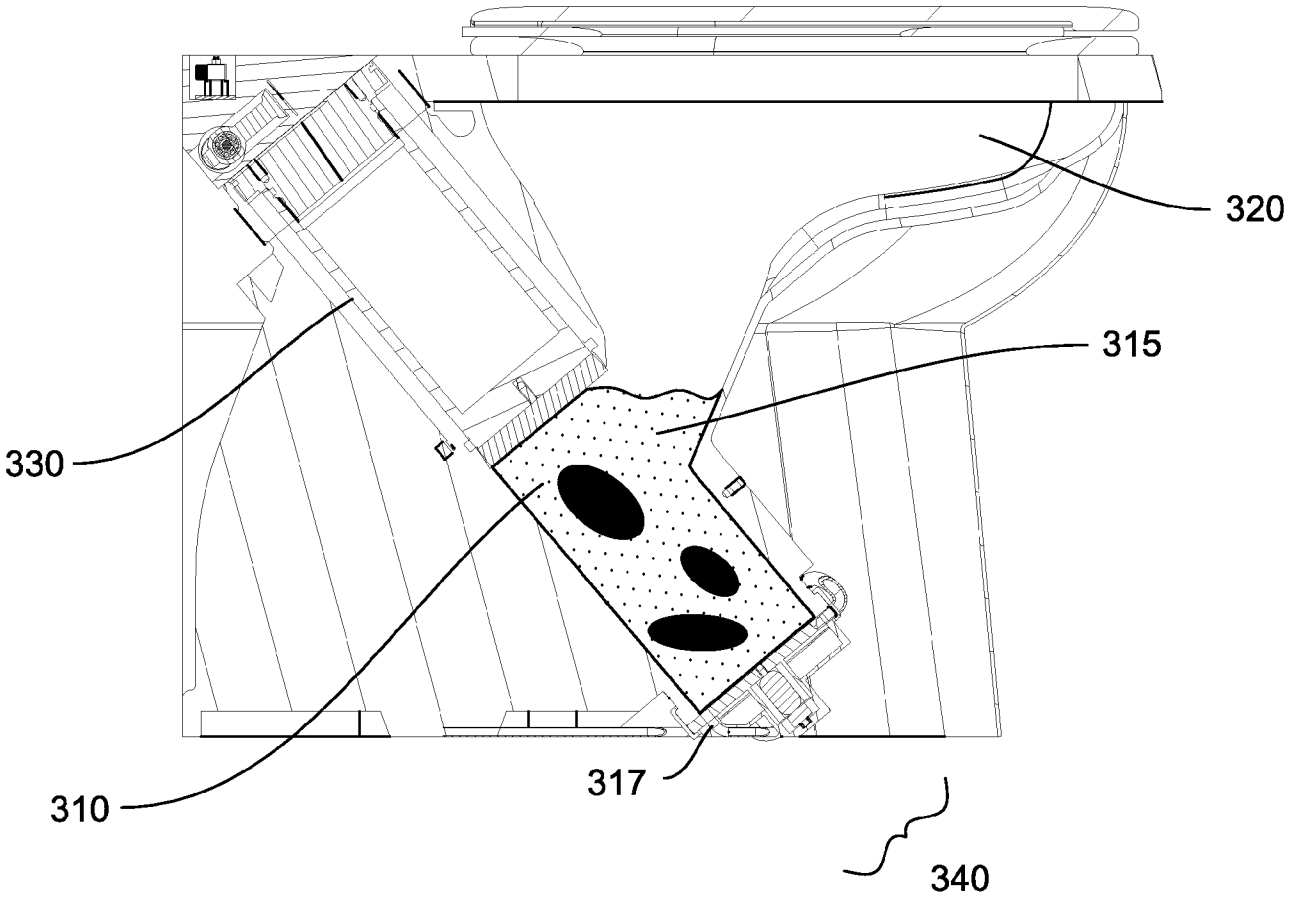
FIG. 3 is a cross-sectional view of an embodiment of a piston-flush toilet system with a piston in a retracted position.

FIG. 3 shows an embodiment of a piston-flush toilet system 300 wherein a piston 330 disposed within a chamber 310 is in a retracted position. In this position, the piston 330 no longer seals a waste inlet 315 allowing waste from a bowl 320 to enter the chamber 310. As the piston 330 retracts, foam may also be introduced into the bowl 320, chamber 310 or both to envelope waste visually and olfactorily. Once waste has transferred from the bowl 320 to the chamber 310 and is possibly enveloped by foam, the piston 330 may move into a compressed position compressing the waste toward a waste outlet 317. While moving into a compressed position, the piston 330 may seal the waste inlet 315 allowing for a macerating unit to turn the waste into slurry without pushing back through the waste inlet 315 into the bowl 320.

Figure 4:
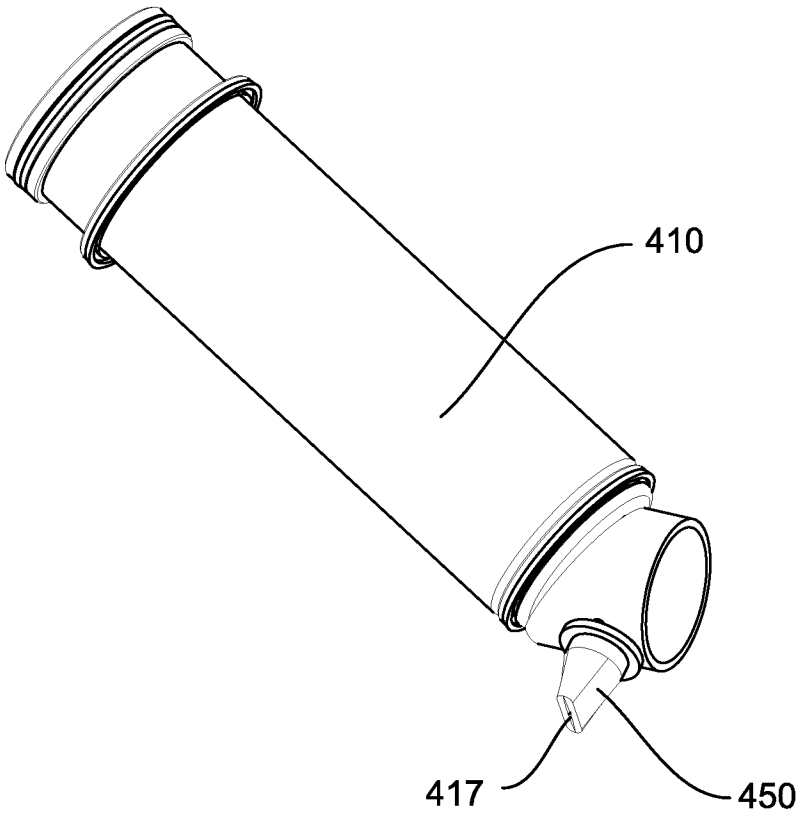
FIG. 4 is a perspective view of an embodiment of a chamber with a one-way valve disposed therein, adjacent a waste outlet.

FIG. 4 shows an embodiment of a chamber 410 with a one-way valve 450 disposed therein, adjacent a waste outlet 417. Such a one-way valve 450 may allow waste to exit the chamber 410 through the waste outlet 417 when compressed by a piston (hidden within the chamber 410) without returning. Such a one-way valve 450 may also block odors from a sewer system or fertilizer production operation from reaching a user.

Figure 5A:
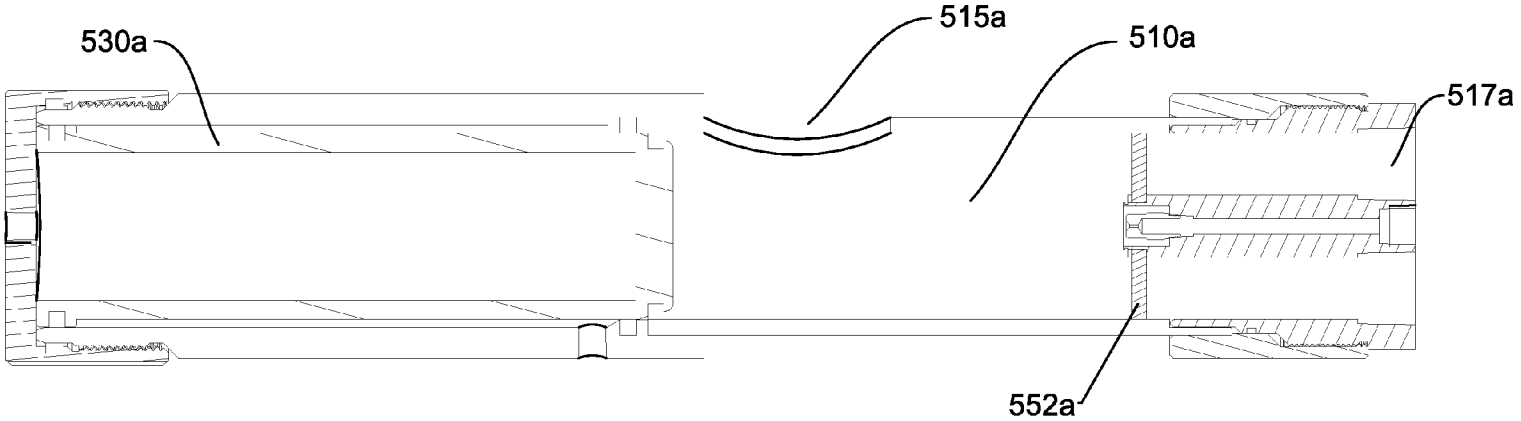
FIGS. 5*a* and 5*b* are longitudinal-section views of embodiments of chambers, each comprising an elastic stopper disposed between a piston and a waste outlet.
Figure 5B:
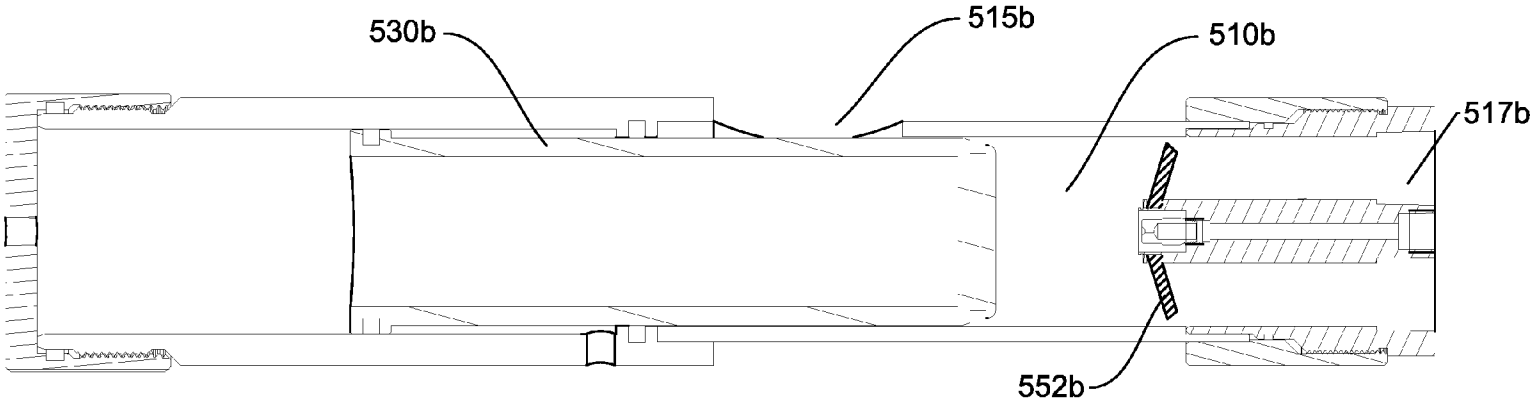

FIGS. 5*a* and 5*b* show embodiments of chambers 510*a* and 510*b*. Each of the chambers 510*a* and 510*b* comprises a piston 530*a* and 530*b* disposed therein and a waste inlet 515*a* and 515*b* and waste outlet 517*a* and 517*b*. An elastic stopper 552*a* and 552*b* may be disposed within each of the chambers 510*a* and 510*b* between the piston 530*a* and 530*b* and the waste outlet 517*a* and 517*b*. In FIG. 5*a*, the piston 530*a* is shown in a retracted position which allows the elastic stopper 552*a* to seal the waste outlet 517*a*, thus blocking waste and odors from entering the chamber 510*a* from the waste outlet 517*a*. When the piston 530*b* is transferred to a compressed position however, as shown in FIG. 5*b*, the elastic stopper 552*b* may deform to allow waste to exit the chamber 510*b* through the waste outlet 517*b*. When the piston 530*a* returns to its retracted position, the elastic stopper 552*a* may then return to its original shape.

Figure 6A:
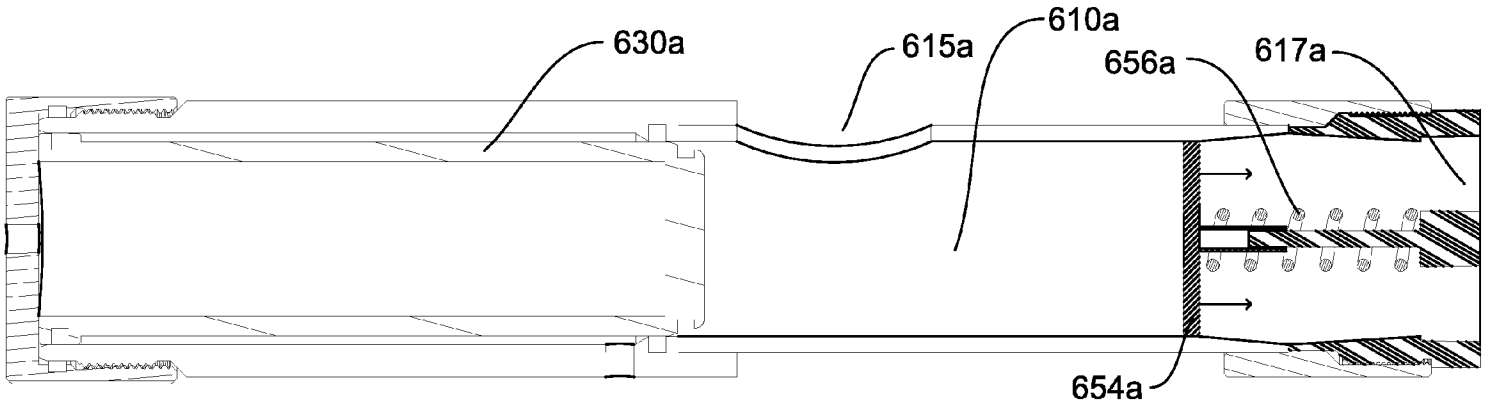
FIGS. 6*a* and 6*b* are longitudinal-section views of embodiments of chambers, each comprising a rigid stopper disposed between a piston and a waste outlet.
Figure 6B:
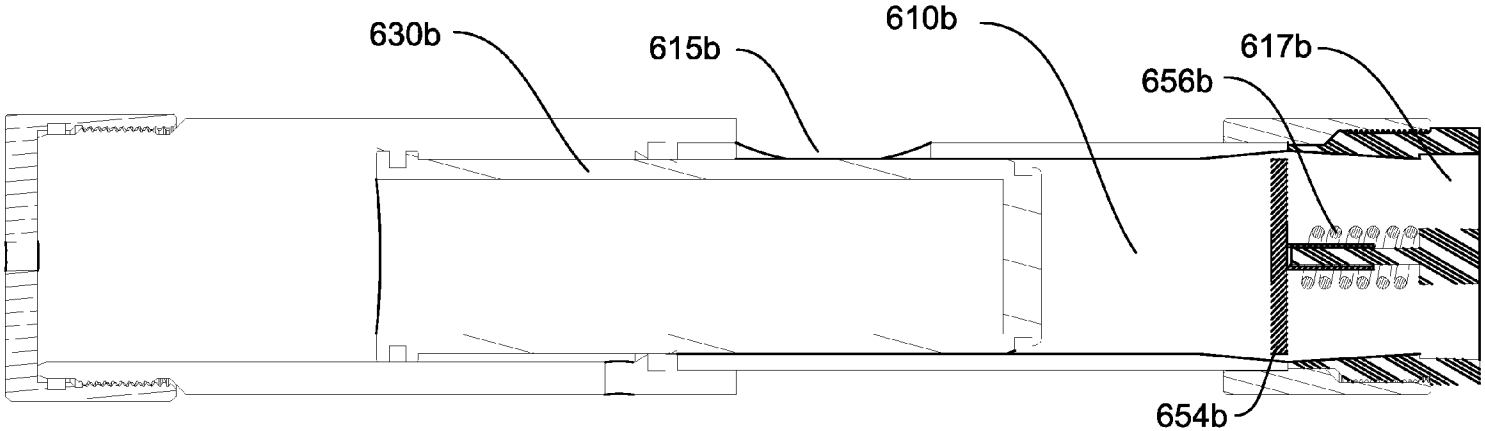

FIGS. 6*a* and 6*b* show embodiments of chambers 610*a* and 610*b*. Each of the chambers 610*a* and 610*b* comprises a piston 630*a* and 630*b* disposed therein and a waste inlet 615*a* and 615*b* and waste outlet 617*a* and 617*b*. A rigid stopper 654*a* and 654*b* may be disposed within each of the chambers 610*a* and 610*b* between the piston 630*a* and 630*b* and the waste outlet 617*a* and 617*b* and held in place by a spring 656*a* and 656*b*. In FIG. 6*a*, the piston 630*a* is shown in a retracted position which allows the rigid stopper 654*a* to seal the waste outlet 617*a*, thus blocking waste and odors from entering the chamber 610*a* from the waste outlet 617*a*. When the piston 630*b* is transferred to a compressed position however, as shown in FIG. 6*b*, the spring 656*b* may deform to allow waste to exit the chamber 610*b* around rigid stopper 654*b* and through the waste outlet 617*b*. When the piston 630*a* returns to its retracted position, the spring 656*a* may then return to its original position.

Figure 7:
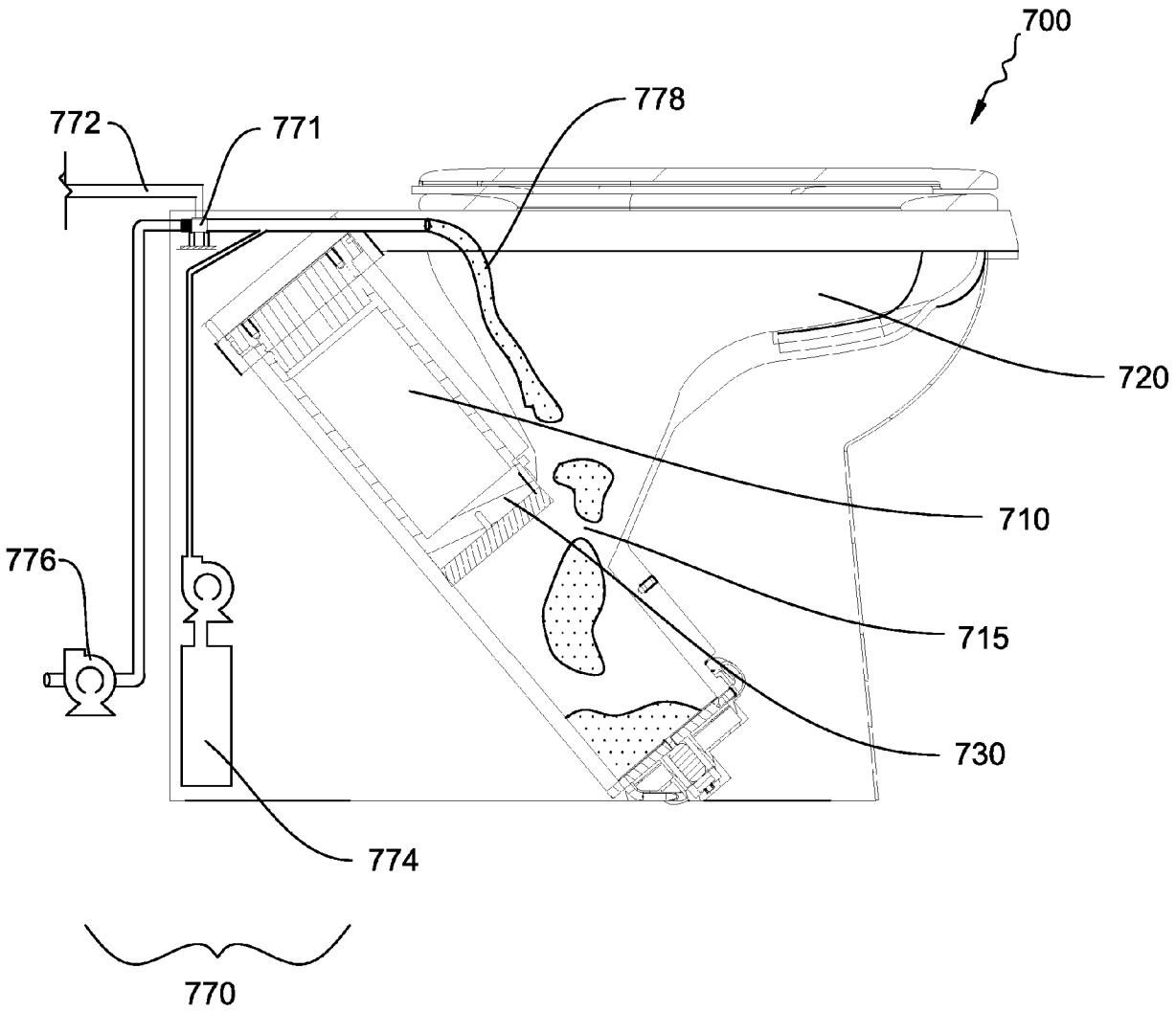
FIG. 7 is a cross-sectional schematic of an embodiment of a piston-flush toilet system comprising a foam generating system.

FIG. 7 shows a schematic of an embodiment of a piston-flush toilet system 700 comprising a foam generating system 770 for supplying foam 778 to a bowl 720 or chamber 710 or both. The foam generating system 770 may comprise a water source 772, such as an external water supply or tank, a surfactant reservoir 774, that may be refilled periodically by a user, and a compressed air source 776, such as a motorized or user-powered air compressor that draws from ambient air as shown or a compressed air tank. Water, surfactant and compressed air may be mixed together at a valve 771 to form foam 778.

In some embodiments, the foam 778 may be supplied to the bowl 720 or chamber 710 or both as a piston 730 retracts and unseals a waste inlet 715. As the piston 730 retracts, a pressure between the piston 730 and a waste outlet 717 of the chamber may decrease resulting in an increase of required force to retract the piston 730. Supplying foam 778 to the chamber 710 may increase the pressure to reduce the force and energy required to retract the piston 730.

In various embodiments, the compressed air source 776 may provide compressed air to pressurize the piston 730 thus moving it between retracted and compressed positions.

Figure 8:
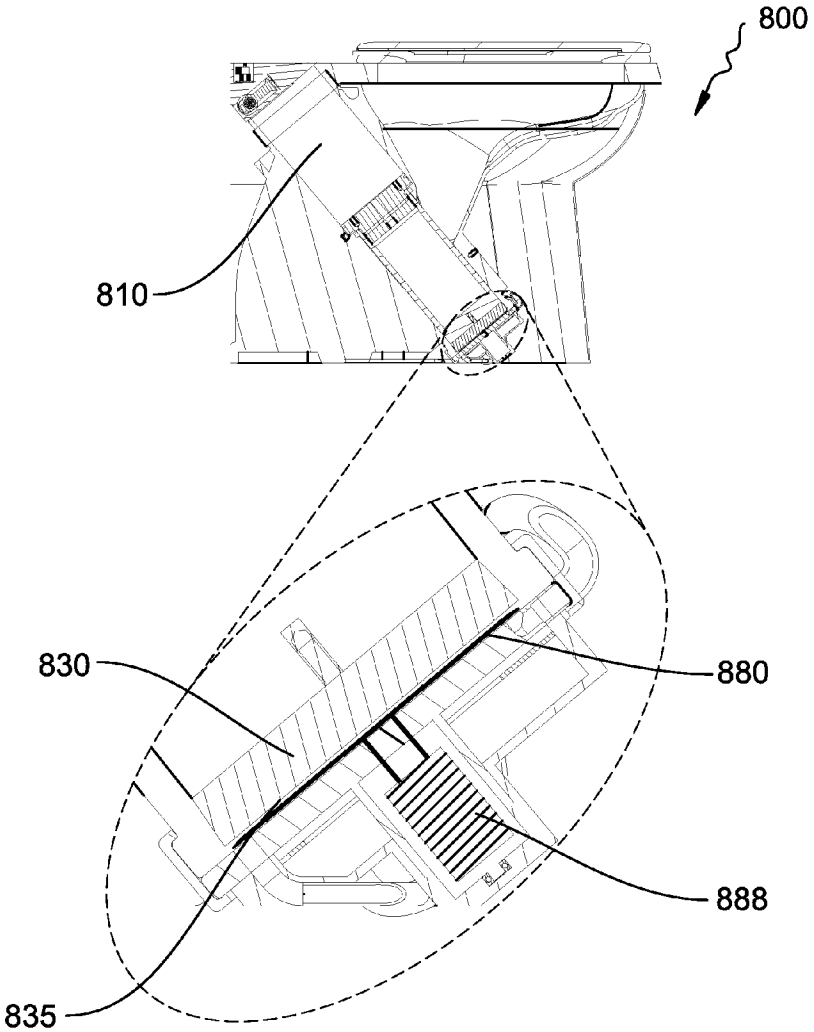
FIG. 8 is a magnified cross-sectional view of an embodiment of a piston-flush toilet system comprising a microchip for measuring characteristics of waste.

FIG. 8 shows an embodiment of a piston-flush toilet system 800 comprising a microchip 880 disposed within a chamber 810 thereof. The microchip 880 may comprise several of a variety of lab-on-a-chip measurement functions as known in the art, each capable of measuring different characteristics of a material placed in contact with a surface of the microchip 880. To obtain a uniform sample of waste for measurement and to remove an appreciable amount of water from that sample that may otherwise dilute the sample, a piston 830 may be disposed within the chamber 810 and compress waste against the microchip 880.

In various embodiments, the microchip 880 may measure characteristics of the waste by measuring light, such as a laser, passing though the waste. This may be performed by providing a light source on an external surface 835 of the piston 830, that passes light through the waste while compressed, that may be at least partially received by the microchip. This may also be performed by providing a reflective surface on the external surface 835 of the piston 830 that may reflect light passing through the waste toward the microchip 880.

The microchip 880 may be connected to a processor 888 that may collect data measured by the microchip 880 for storage or transmittal. It is believed that such measurements may aid in monitoring the health of a user of the piston-flush toilet system 800.

Figure 9A:
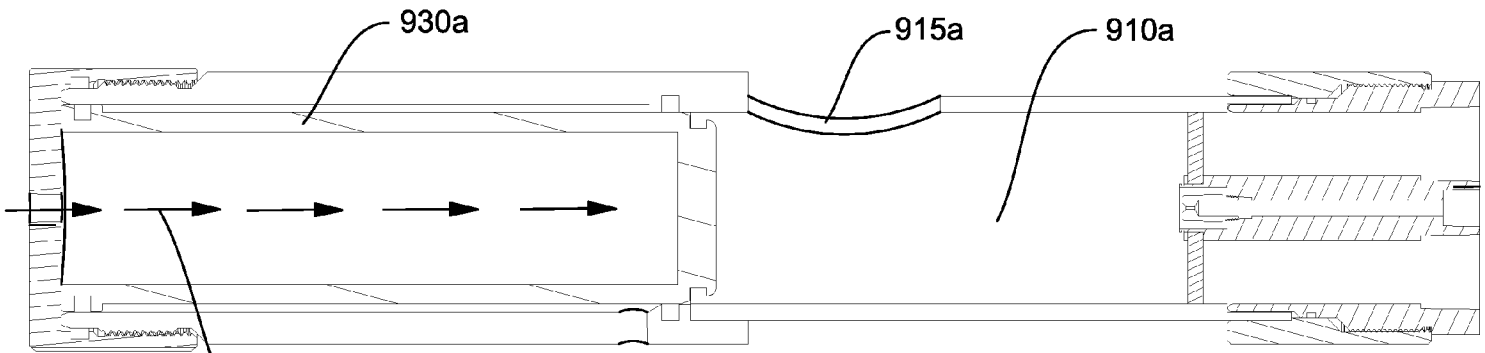
FIGS. 9*a* and 9*b* are longitudinal-section views of chambers in retracted and compressed positions respectively.
Figure 9B:
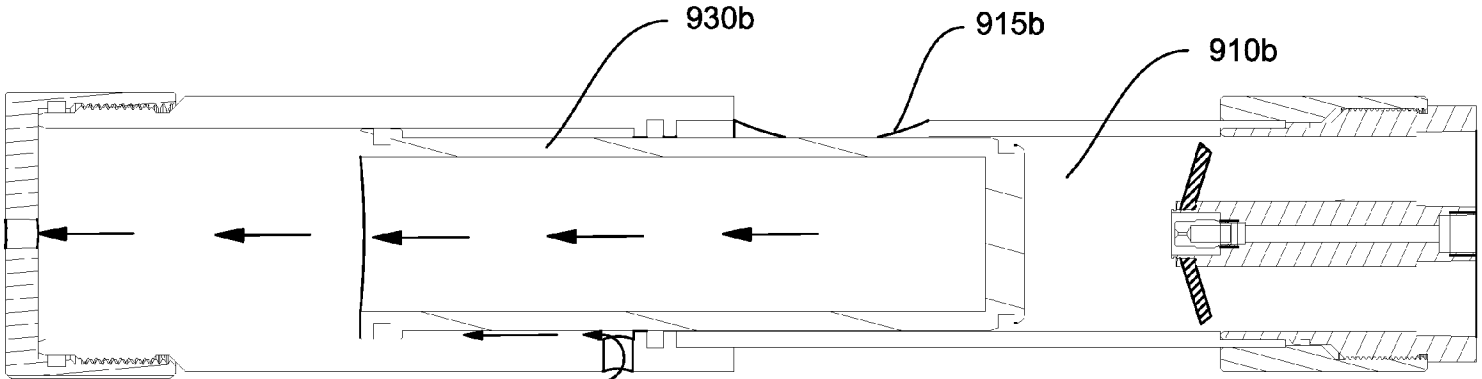

FIGS. 9*a* and 9*b* show embodiments of chambers 910*a* and 910*b*, each comprising a piston 930*a* and 930*b* disposed therein. In FIG. 9*a*, piston 930*a* is shown in a retracted position which unseals a waste inlet 915*a*. In various embodiments, compressed air 990*a*, or another fluid, may be channeled into the chamber 910*a* to pressurize the piston 930*a* and translated it from a retracted position to a compressed position, thus sealing the waste inlet 915*a*. In FIG. 9*b*, compressed air 990*b*, or another fluid, is channeled into the chamber 910*b* to surround the piston 930*b* and translate it back from a compressed position to a retracted position, thus unsealing the waste inlet 915*b*.

Whereas the present invention has been described in particular relation to the drawings attached hereto, it should be understood that other and further modifications apart from those shown or suggested herein, may be made within the scope and spirit of the present invention.

What is claimed is:

1. A piston-flush toilet system, comprising:

a bowl to accept waste;

a compressed air source for providing compressed air;

a chamber comprising a waste inlet connected to the bowl and a waste outlet, the waste outlet having an adjacent one-way valve which allows the waste to exit the chamber when compressed by a piston;

the piston disposed within the chamber seals the waste inlet and compresses the waste through the one-way valve as the compressed air is used to pressurize the piston; and wherein the compressed air is used to pressurize the piston between retracted and compressed positions and to produce foam.

2. The piston-flush toilet system of claim 1, wherein the chamber is positioned beneath the bowl such that gravity transports waste from the bowl to the chamber.

3. The piston-flush toilet system of claim 1, wherein the chamber is positioned at an angle such that gravity transports waste entering the chamber at the waste inlet to the waste outlet.

4. The piston-flush toilet system of claim 1, further comprising a macerating unit disposed within the chamber between the piston and the waste outlet.

5. The piston-flush toilet system of claim 1, further comprising an elastic stopper disposed within the chamber between the piston and the waste outlet wherein the elastic stopper deforms when pressurized by the piston and returns to its original shape when not pressurized.

6. The piston-flush toilet system of claim 1, further comprising a rigid stopper disposed within the chamber between the piston and the waste outlet held in place by a spring that deforms when pressurized by the piston and returns to its original position when not pressurized.

7. The piston-flush toilet system of claim 1, further comprising a foam generating system for supplying foam to the bowl or chamber or both.

8. The piston-flush toilet system of claim 7, wherein the foam is supplied to the bowl or chamber or both as the piston retracts.

9. The piston-flush toilet system of claim 7, wherein the foam comprises a lubricant to aid gravity in transporting waste from the bowl to the chamber.

10. The piston-flush toilet system of claim 1, wherein the bowl and chamber are formed of a solid member.

11. The piston-flush toilet system of claim 1, wherein the bowl and chamber are formed of plastic.

12. The piston-flush toilet system of claim 1, further comprising a microchip, for measuring characteristics of the waste, disposed within the chamber.

13. The piston-flush toilet system of claim 12, wherein the piston compresses waste against the microchip.

14. The piston-flush toilet system of claim 13, wherein the piston comprises a reflective surface that reflects light passing through the waste to the microchip.

15. The piston-flush toilet system of claim 13, wherein the piston comprises a light source that passes light through the waste to the microchip.

* * * * *